United States Patent [19]

Anderson

[11] Patent Number: 4,979,984

[45] Date of Patent: Dec. 25, 1990

[54] PROCESS FOR THE MANUFACTURE OF AN INSERT

[75] Inventor: Linwood R. Anderson, Roscoe, Ill.

[73] Assignee: Inserts Ltd., Cedar Rapids, Iowa

[21] Appl. No.: 495,792

[22] Filed: Mar. 16, 1990

[51] Int. Cl.[5] ..... B22F 1/00

[52] U.S. Cl. ..... 75/228; 419/25; 419/38; 419/39; 419/47; 419/60; 419/54

[58] Field of Search ..... 419/38, 39, 47, 25, 419/60, 54; 75/228

[56] References Cited

U.S. PATENT DOCUMENTS

| | | | |
|---|---|---|---|
| 4,299,629 | 11/1981 | Haack | 419/39 |
| 4,343,651 | 8/1982 | Yazu et al. | 75/238 |
| 4,613,369 | 9/1986 | Koehler | 419/38 |

*Primary Examiner*—Stephen J. Lechert, Jr.

*Attorney, Agent, or Firm*—David J. Archer

[57] ABSTRACT

A process is claimed for the manufacture of an insert. The process includes the steps of filling a die cavity defined by a die mold with powdered metal, the die cavity conforming to the required shape of the insert. The powdered metal is compressed within the die cavity such that a compact of the insert is formed within the die cavity. The compact is sintered within a sintering furnace so that a first porton of the compact is in the solid phase and a second portion of the compact is in the liquid phase. The compact is rapidly cooled within the sintering furnace to a temperature below the melting point of the powdered metal. Such temperature is maintained so that densification of the first portion to substantially full density is achieved. The arrangement is such that the profile integrity of the compact is retained. the resltant insert is then subsequently cooled.

20 Claims, 2 Drawing Sheets

FIG. 10.
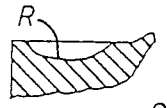
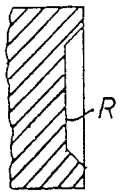
FIG. 9.
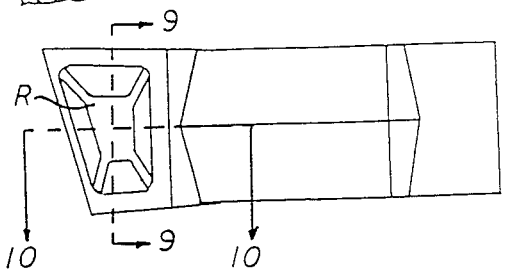
FIG. 8.
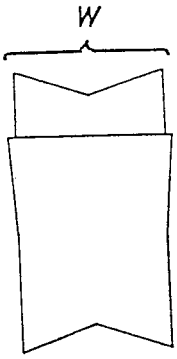
FIG. 6.
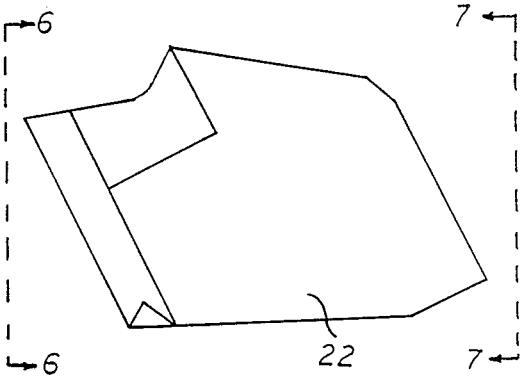
FIG. 5.
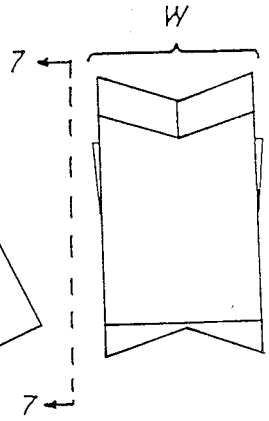
FIG. 7.
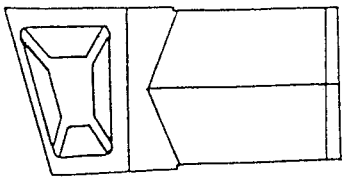
FIG. 11.

PROCESS FOR THE MANUFACTURE OF AN INSERT

BACKGROUND OF THE INVENTION

1 Field of the invention.

The present invention relates to a process for the manufacture of an insert. More particularly, the present invention relates to a process for the manufacture of an insert from powdered metal which is subsequently sintered.

2 Information disclosure statement.

The present invention is particularly but not exclusively applicable to replaceable inserts for a cutoff tool of a screw machine.

In a typical screw machine, a cutoff tool moves radially relative to a rotating workpiece for performing parting and grooving operations relative to the workpiece.

More particularly, as the workpiece is rotated and the cutoff tool is brought into engagement with the rotating surface of the workpiece, the rotating surface rotates at a relatively high surface speed relative to the cutoff tool. However, although the rotational speed of the workpiece remains constant, the surface speed gradually decreases as the cutoff tool moves radially towards the axis of rotation of the workpiece.

Although cemented carbide or cermet inserts have been proposed, such carbide inserts tend to chip and break when used at the aforementioned relatively low surface speeds encountered in cutoff operations.

Such low surface speeds which may be in the order of 0.10 to 250 ft./min. require the provision of a high speed steel blade. Such high speed steel blades have been successfully applied at any speed as they have the required toughness characteristics to withstand low surface speed cutoff operations without breaking or chipping.

Nevertheless, high speed steel blades require frequent regrinding which is time consuming and labor intensive.

The present invention provides a replaceable insert and a method of manufacture thereof which is tough enough to withstand the rigors of low surface speed cutoff operations while combining the advantages of being readily replaceable as an insert within a suitable holder.

Furthermore, the insert of the present invention may have a cutting width of as little as 0.025 inches while maintaining the required toughness to withstand chipping and breakage of the insert at very low surface speeds.

Those skilled in the art will readily appreciate that by use of a cutting width of as low as 0.025 inches, the amount of metal removed during the cutoff operation is minimal thereby resulting in a corresponding saving of materials.

The present invention overcomes the aforementioned problems associated with high speed steel tools which require periodic regrinding. Also, the present invention provides a process for the manufacture of an insert having a microstructure exhibiting a uniform distribution of carbides throughout. Additionally, the present invention overcomes the problem of segregation during the molding process.

An article by Ralph W. Stevenson entitled "Powder metallurgy Tool Steels" describes the Fulden process for manufacturing replaceable inserts having improved properties and product performance. The Fulden process provides an insert having nearly 100% full density.

The Fulden process essentially includes the steps of compacting powdered metal and subsequently heating the compact within a sintering furnace in order to achieve nearly 100% full density within the resultant insert.

In the present invention the unexpected discovery was made that by heating the compact to a first temperature just above the melting point of the powdered metal until a first portion of the powdered metal melts and then rapidly cooling the compact to a few degrees below the melting point, densification of a first portion of the powdered metal in the solid phase takes place. Furthermore, by the process according to the present invention, the profile integrity of the compact is maintained and the resultant insert can be reproduced to within an extremely narrow tolerance.

Also, an insert having a cutting width within the range 0.025 to 0.500 inches can be manufactured according to the present invention, the insert having the necessary toughness for low speed applications.

Additionally, inserts produced according to the present invention may be coated because no grinding of the resultant insert is required whereas coating the prior art high speed steel tools was redundant because such coating would be removed during regrinding.

The inserts according to the present invention are particularly suitable for low speed cutoff and grooving operations on a screw machine.

In view of the reproducibility to within a close tolerance, the insert according to the present invention enables automatic precision machining to be restored subsequent to insert replacement without the need for grinding or other adjustments.

The present invention includes sintering the compressed powdered metal in an evacuated furnace until 60 to 80% of the insert is in the liquid phase and then reducing the temperature in order to achieve densification of the remaining 20 to 40% of the insert that is in the solid phase. The resultant insert after cooling thereof has improved properties particularly for low surface speed operations.

The present invention therefor provides an improved process that overcomes the problems associated with the prior art high speed steel tools that require grinding and provides an insert and method of manufacture thereof that makes a considerable contribution to the art of manufacturing cutting tools.

Another object of the present invention is the provision of a process that provides an insert for low surface speed application while avoiding the inconvenience of grinding.

Another object of the present invention is the provision of a process that provides an insert that does not require time consuming grinding thereof and which can be manufactured to within a narrow tolerance.

Another object of the present invention is the provision of a process that provides an insert which maintains the profile integrity of the compact from which the insert is formed.

Another object of the present invention is the provision of a process that provides a narrow insert thereby reducing the amount of waste metal removed from the workpiece during cutoff operations.

Other objects and advantages of the present invention will be readily apparent to those skilled in the art by a consideration of the detailed description contained hereinafter taken in conjunction with the annexed drawings

SUMMARY OF THE INVENTION

The present invention relates to a process for the manufacture of an insert. The process includes the steps of filling a die cavity defined by a die mold with powdered metal, the die cavity conforming to the required shape of the insert. The powdered metal is then compressed within the die cavity such that a compact of the insert is formed within the die cavity. The compact is then sintered so that a first portion of the compact is in the solid phase and a second portion of the compact is in the liquid phase. The temperature is then rapidly lowered to below the melting point so that densification of the first portion is achieved while maintaining the profile integrity of the compact. The resultant insert is then cooled.

In a more specific method of carrying out the present invention, the filling step includes depositing the powdered metal within the die cavity and an extension thereof such that the volume of the powdered metal within the extension to the volume of the powdered metal within the die cavity is in the ratio 2:1.

Furthermore, the step of compressing the powdered metal is carried out at ambient temperature. More specifically, the powdered metal within both the extension and the die cavity are compressed at ambient temperature.

The compressing step includes applying a pressure to the powdered metal within the range 20 to 50 tons per square inch.

The compressing step involves moving a die ram movably disposed within the extension and the die cavity such that the combined volume of the powdered metal within the extension and the die cavity is reduced to the volume of the die cavity. A clearance is provided between the die ram and the extension for permitting air within the powdered metal to escape during the compressing step, the clearance being within the range 0.0005 to 0.0015 inches. The sintering step includes placing the compact within a sintering furnace, the furnace being connected to a source of partial vacuum.

The furnace is heated to a first temperature such that the compact begins to melt so that the second portion in the liquid phase is formed. The temperature is then reduced to a second temperature which is lower than the first temperature such that the density of the first portion increases. The furnace is maintained at the second temperature such that densification of the compact proceeds during the step of sintering.

More specifically, the furnace is heated to the first temperature so that the first portion is within the range 20 to 40% by weight of the weight of the insert. Also, the second portion is within the range 60 to 80% by weight of the weight of the insert.

The first temperature is within a range 1° to 10° F. and preferably within the range 3 to 5 degrees F. above the melting point of the powdered metal within the furnace while connected to the source of partial vacuum.

Additionally, the second temperature is within a range 1° to 10° F. and preferably within the range 3 to 5 degrees F. below the melting point of the powdered metal at the reduced pressure within the furnace.

The sintering step includes maintaining the compact within the furnace for a period within the range 3 to 4 hours at the second temperature in order to achieve the desired densification of the first portion of the compact.

The rapid cooling step is accomplished during a period within the range 1 to 10 minutes.

Also, the cooling step is carried out in an inert atmosphere during a period within the range 1 to 4 hours.

Alternatively, the cooling step is carried out in the sintering furnace during a period of at least 12 hours.

Many modifications and variations of the present process will be readily apparent to those skilled in the art by a consideration of the detailed description contained hereinafter taken in conjunction with the annexed drawings which set forth a preferred embodiment of the present invention. However such modifications and variations fall within the spirit and scope of the present invention as recited in the appended claims.

Included in such modifications would be maintaining the first and second temperature equal and altering the partial vacuum in order to achieve the desired densification of the powdered metal.

BRIEF DESCRIPTION OF THE DRAWINGS

FIG. 5 is a side elevational view of the resultant insert according to the process of the present invention;

FIG. 6 is a front view of the insert as viewed on the line 6—6 shown in FIG. 5;

FIG. 7 is a view taken on the line 7—7 of FIG. 5;

FIG. 8 is a top plan view of the insert as shown in FIG. 5 when viewed on the line 8—8 of FIG. 5

FIG. 9 is a sectional view taken on the line 9—9 of FIG. 8;

FIG. 10 is a sectional view taken on the line 10-10 shown in FIG. 8; and FIG. 11 is a view similar to that shown in FIG. 8 but shows an alternative shape insert.

Similar reference characters refer to similar parts throughout the various figures of the drawings.

DETAILED DESCRIPTION OF THE DRAWINGS

Figure 1:
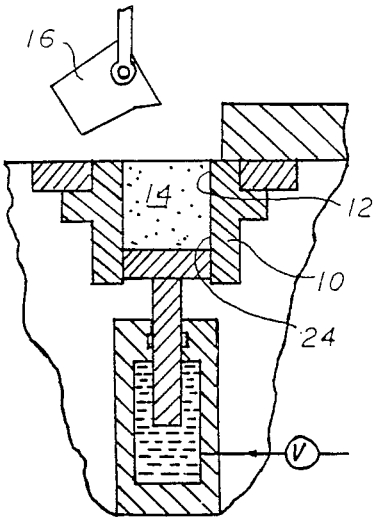
FIG. 1 is a sectional view of a die mold for carrying out the process according to the present invention and shows the die cavity being filled with powdered metal.

FIG. 1 is a sectional view of a die mold 10 for carrying out the process according to the present invention.

The die mold 10 defines a die cavity 12 which is filled with powdered metal 14 by means of a ladle 16 or the like. The powdered metal 14 fills the die cavity 12 which conforms to the shape of the required insert.

Figure 2:
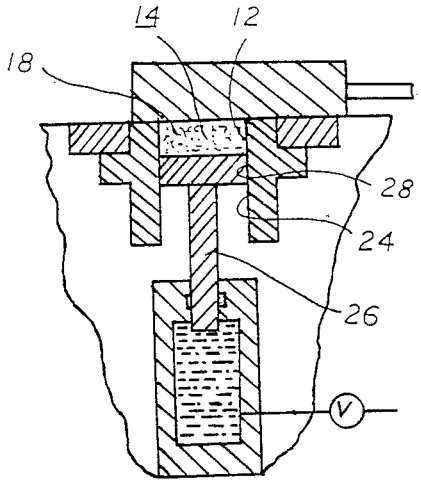
FIG. 2 is a similar view to that shown in FIG. 1 but shows the powdered metal being compressed within the die cavity.

FIG. 2 shows the powdered metal 14 being compressed within the die cavity 12 such that a compact 18 is formed within the die cavity 12.

Figure 3:
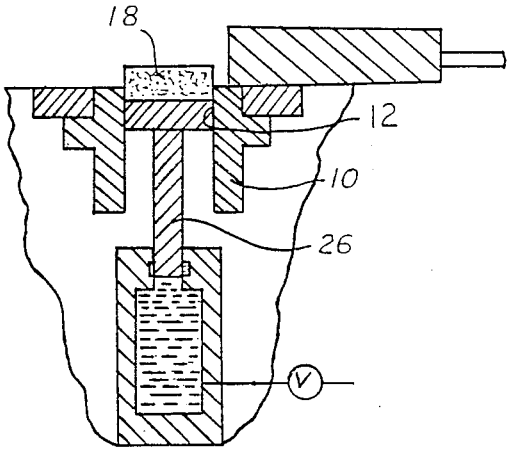
FIG. 3 is a similar view to that shown in FIG. 1. but shows the compact being ejected from the die cavity.

FIG. 3 shows the compact 18 being ejected from the die cavity 12.

Figure 4:
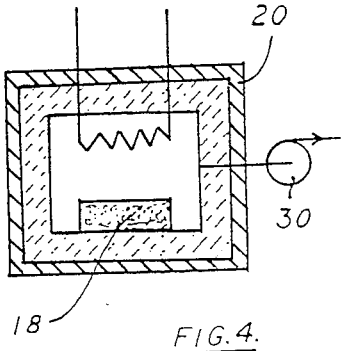
FIG. 4 shows the compact disposed within a sintering furnace, the furnace being connected to a source of partial pressure.

FIG. 4 is a sectional view of a sintering furnace 20 with the compact 18 disposed therein. The compact 18 is sintered within the furnace 20 such that a first portion of the compact 18 is in the solid phase while a second portion is in the liquid phase.

FIG. 5 shows the resultant insert 22 after the cooling step.

More specifically, the powdered metal 14 is deposited within the die cavity 12 and an extension 24 of the die cavity 12 such that the volume of the powdered metal 14 within the extension 24 to the volume of powdered metal 14 within the die cavity 12 is within the ratio of approximately 2:1.

The step of compressing the powdered metal as shown in FIG. 2 is carried out at ambient temperature. The pressure applied to the powdered metal within the die cavity 12 is within the range 20 to 50 tsi.

A die ram 26 movably disposed within the extension 24 moves towards the die cavity 12 such that the combined volume of the powdered metal 14 within the extension 24 and the die cavity 12 is reduced to the volume of the die cavity.

A clearance 28 is provided between the ram 26 and the extension 24 for permitting the escape of air from within the powdered metal during the compression step. Preferably, the clearance 28 is within the range 0.0005 to 0.0015 inches.

FIG. 3 shows the compact being ejected from the die cavity 12. The sintering step as shown in FIG. 4 includes placing the compact 18 within the sintering furnace 20. The furnace 20 is connected to a source of partial pressure 30 such as a vacuum pump.

The furnace 20 is heated to a first temperature such that the compact begins to melt so that the second portion of the compact in the liquid phase is formed.

At this point, the temperature is rapidly reduced to a second temperature which is below the first temperature such that densification of the remaining portion in the solid phase is achieved.

The second temperature is maintained so that densification of the compact proceeds during the sintering step, thereby increasing the density of the first portion.

More specifically, the first temperature is such that the first portion is within the range 20 to 40% by weight of the weight of the insert 22 and the second portion is within the range 60 to 80% by weight of the weight of the insert.

In a preferred method according to the present invention, the first temperature is within the range 3° to 5° F. above the melting point of the compact 18 at the reduced pressure within the furnace 20. Also, the second temperature is within the range 3° to 5° F. below the melting point of the compact under reduced pressure in the sintering furnace 20.

The sintering step as shown in FIG. 4 is maintained at the second temperature during a period within the range 3 to 4 hours.

Also, the rapid cooling step is achieved within a period within the range 1 to 10 minutes so that the profile integrity of the compact is maintained. When the compact is not rapidly cooled the compact tends to lose the original profile or shape of the compact when ejected from the die cavity. Additionally, it is important according to the present invention to carry out the rapid cooling step as soon as the ratio of the solid to liquid phase is achieved. Preferably, the ratio of solid to liquid phase is substantially 25% solid 75% liquid by weight.

Cooling is carried out in an inert atmosphere at ambient temperature during a period within the range 1 to 4 hours.

FIG. 5 is an elevational view of the insert 22 according to the method disclosed in the present invention. The insert typically has a TRS of 680,000 and a hardness within the range 60–71 on the Rockwell "C" scale. The cutting angle is within the range 0° to 45° left or right.

FIG. 6 is a view taken on the line 6—6 of FIG. 5 and FIG. 7 is a view taken on the line 7—7 of FIG. 5. Both FIGS. 6 and 7 show the width W of the insert 22 as 0.1875 inches. However, the width may be within the range 0.025 to 0.500 inches.

FIG. 8 is a top plan view of the insert as viewed on the line 8—8 of FIG. 5 showing the width W.

FIGS. 9 and 10 are sectional views taken on the lines 9—9 and 10—10 respectively of FIG. 8 in order to show the shape of a recess R formed in the insert 22.

FIG. 11 is a similar view to that shown in FIG. 8 but shows an alternative shape insert.

In an alternative method of cooling, such cooling is carried out within the sintering furnace 20 during a period of at least 12 hourswithout application of vacuum or heat to the furnace.

Powdered metals particularly but not exclusively suitable for use in the process according to the present invention are M2, M42, and T15 which have substantially the following compositions:

| | W | Cr | V | Mo | Co |
|---|---|---|---|---|---|
| M2 | 6 | 4 | 2 | 5 | — |
| M42 | 1.5 | 3.75 | 1.15 | 9.5 | 8 |
| T15 | 12 | 4 | 5 | — | 5 |

The present invention provides an improved process for the manufacture of inserts that are particularly advantageous in the machining and cutoff of materials at low speeds.

What is claimed is:

1. A process for the manufacture of an insert, said process comprising the steps of:

filling a die cavity defined by a die mold with powdered metal, the die cavity conforming to the required shape of the insert;

compressing the powdered metal within the die cavity such that a compact of the insert is formed within the die cavity;

placing the compact within a sintering furnace;

sintering the compact within the sintering furnace so that a first portion of the compact is in the solid phase and a second portion of the compact is in the liquid phase;

rapidly cooling the compact within the sintering furnace to a temperature below the melting point of the powdered metal;

maintaining the temperature of the compact at the temperature below the melting point such that densification of the first portion to substantially full density is achieved so that the profile integrity of the compact is retained; and cooling the resultant insert.

2. A process as set forth in claim 1 wherein said filling step includes:

depositing the powdered metal within the die cavity and an extension of the die cavity such that the volume of the powdered metal within the extension to the volume of powdered metal within the die cavity is in the ratio of approximately 2:1.

3. A process as set forth in claim 1 wherein the step of compressing the powdered metal is carried out at ambient temperature.

4. A process as set forth in claim 2 wherein the step of compressing the powdered metal within the die cavity and extension is carried out at ambient temperature.

5. A process as set forth in claim 2 wherein the step of compressing the powdered metal within the die cavity and extension includes:

applying a pressure within the range 20 to 50 tons per square inch to the powdered metal.

6. A process as set forth in claim 5 wherein the step of compressing the powdered metal includes:

moving a die ram movably disposed within the extension towards the die cavity such that the combined volume of the powdered metal within the extension and the die cavity is reduced to the volume of the die cavity.

7. A process as set forth in claim 6 wherein the step of compressing the powdered metal includes:

providing a clearance between the die ram and the extension for permitting air within the powdered metal to escape during the step of compressing, the clearance being within the range 0.0005 to 0.0015 inches.

8. A process as set forth in claim 1 wherein the step of sintering includes:

connecting the furnace to a source of partial vacuum.

9. A process as set forth in claim 8 wherein the step of sintering further includes:

heating the furnace to a first temperature such that the compact begins to melt so that the second portion in the liquid phase is formed;

reducing the temperature within the furnace to a second temperature such that the density of the first portion increases;

maintaining the furnace at the second temperature such that densification of the compact proceeds during the step of sintering.

10. A process as set forth in claim 9 wherein the step of heating the furnace includes:

heating the furnace to the first temperature such that the first portion is within the range 20 to 40% by weight of the volume of the insert.

11. A process as set forth in claim 9 wherein the step of heating the furnace includes:

heating the furnace to the first temperature such that the second portionis within the range 60 to 80% by weight of the weight of the insert.

12. A process as set forth in claim 9 wherein the first temperature is within the range 1° to 10° F. above the melting point of the powdered metal within the furnace connected to the source of partial vacuum.

13. A process as set forth in claim 9 wherein the second temperature is within the range 1° to 10° F. below the melting point of the powdered metal within the furnace connected to the source of partial vacuum.

14. A process as set forth in claim 9 wherein the first temperature is within the range 3° to 5° F. above the melting point and the second temperature is within the range 3° to 5° F. below the melting point of the powdered metal within the furnace connected to the source of partial vacuum.

15. A process as set forth in claim 8 wherein the step of sintering includes:

maintaining the compact within the furnace for a period within the range 3 to 4 hours.

16. A process as set forth in claim 1 wherein the step of rapidly cooling the compact is accomplished within a period within the range 1 to 10 minutes.

17. A process as set forth in claim 1 wherein the step of cooling is carried out in an inert atmosphere during a period within the range 1 to 4 hours.

18. A process as set forth in claim 1 wherein the step of cooling is carried out in the sintering furnace during a period of at least 12 hours.

19. A process for the manufacture of an insert, said process comprising the steps of:

filling a die cavity defined by a die mold with powdered metal, the die cavity conforming to the required shape of the insert;

compressing the powdered metal within the die cavity such that a compact of the insert is formed within the die cavity;

sintering the compact under reduced pressure at a first temperature such that a first portion of the compact is in the solid phase and a second portion of the compact is in the liquid phase;

reducing the temperature to a second temperature such that densification of the compact is achieved during the sintering step, the second temperature being within the range 3° to 5° F. below the melting point of the powdered metal at the reduced pressure; and cooling the resultant insert.

20. An insert manufactured according to the process set forth in claim 1. wherein the insert has a cutting width within the range 0.025 to 0.500 inches.

* * * * *